US006415960B1

(12) United States Patent
Fink et al.

(10) Patent No.: US 6,415,960 B1
(45) Date of Patent: Jul. 9, 2002

(54) ARM-MOUNTABLE LIQUID DISPENSING APPARATUS

(76) Inventors: Karen E. Fink, 8260 Beaver Ridge Dr. Apt. #1706, North Royalton, OH (US) 44133; Diana L. Kubajak, 6165 Spieth Rd., Medina, OH (US) 44256

( * ) Notice: Subject to any disclaimer, the term of this patent is extended or adjusted under 35 U.S.C. 154(b) by 0 days.

(21) Appl. No.: 09/952,863

(22) Filed: Sep. 14, 2001

(51) Int. Cl.[7] ..... B67D 5/64
(52) U.S. Cl. ..... 222/175; 222/529
(58) Field of Search ..... 272/175, 529; 604/250

(56) References Cited

U.S. PATENT DOCUMENTS 3,915,167 A * 10/1975 Waterman ..... 604/250
3,974,942 A 8/1976 Gray et al.
4,090,650 A 5/1978 Gotta
5,445,596 A 8/1995 Grace
5,538,164 A * 7/1996 Rivas ..... 222/175
5,566,869 A 10/1996 Katz
5,851,077 A 12/1998 Trejo
D416,676 S 11/1999 Fitzgerald
5,984,145 A * 11/1999 McAllister ..... 222/175

* cited by examiner

*Primary Examiner*—Philippe Derakshani

(57) ABSTRACT

A liquid dispensing apparatus for removably coupling to an arm of a user. The liquid dispensing apparatus includes a container for holding a liquid. The container includes a first wall, a second wall and a peripheral wall extending between the first and second walls to define an interior for receiving the liquid. A port having a hole extending through it is provided for expelling the liquid. A conduit is provided for transporting the liquid from the container to the port. A first end of the conduit is fluidly connected to a second wall of the container. A second end of the conduit is fluidly connected to the port. A valve assembly is provided for controlling the flow of liquid through the conduit and is operationally coupled to a portion of the conduit. A plurality of fastening members is provided for fastening the apparatus to the arm of the user.

12 Claims, 3 Drawing Sheets

ARM-MOUNTABLE LIQUID DISPENSING APPARATUS

BACKGROUND OF THE INVENTION

1. Field of the Invention

The present invention relates to liquid dispensers and more particularly pertains to a new liquid dispensing apparatus for removably coupling to an arm of a user.

2. Description of the Prior Art

The use of liquid dispensers is known in the prior art. More specifically, liquid dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,974,942; 5,851,077; 5,566,869; 5,445,596; 4,090,650; and U.S. Pat. No. Des. 416,676.

While these devices fulfill their respective, particular objectives and requirements, the aforementioned patents do not disclose a new liquid dispensing apparatus. The inventive device includes a container for holding a liquid. The container includes a first wall, a second wall and a peripheral wall extending between the first and second walls to define an interior for receiving the liquid. A port having a hole extending through it is provided for expelling the liquid. A conduit is provided for transporting the liquid from the container to the port. A first end of the conduit is fluidly connected to a second wall of the container. A second end of the conduit is fluidly connected to the port. A valve assembly is provided for controlling the flow of liquid through the conduit and is operationally coupled to a portion of the conduit. A plurality of fastening members is provided for fastening the apparatus to the arm of the user. One of the fastening members is mounted on the container and one of the fastening members is mounted on the port.

In these respects, the liquid dispensing apparatus according to the present invention substantially departs from the conventional concepts and designs of the prior art, and in so doing provides an apparatus primarily developed for the purpose of removably coupling to an arm of a user.

SUMMARY OF THE INVENTION

In view of the foregoing disadvantages inherent in the known types of liquid dispensers now present in the prior art, the present invention provides a new liquid dispensing apparatus construction wherein the same can be utilized for removably coupling to an arm of a user.

The general purpose of the present invention, which will be described subsequently in greater detail, is to provide a new liquid dispensing apparatus apparatus and method which has many of the advantages of the liquid dispensers mentioned heretofore and many novel features that result in a new liquid dispensing apparatus which is not anticipated, rendered obvious, suggested, or even implied by any of the prior art liquid dispensers, either alone or in any combination thereof.

To attain this, the present invention generally comprises a container for holding a liquid. The container includes a first wall, a second wall and a peripheral wall extending between the first and second walls to define an interior for receiving the liquid. A port having a hole extending through it is provided for expelling the liquid. A conduit is provided for transporting the liquid from the container to the port. A first end of the conduit is fluidly connected to a second wall of the container. A second end of the conduit is fluidly connected to the port. A valve assembly is provided for controlling the flow of liquid through the conduit and is operationally coupled to a portion of the conduit. A plurality of fastening members is provided for fastening the apparatus to the arm of the user. One of the fastening members is mounted on the container and one of the fastening members is mounted on the port.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new liquid dispensing apparatus apparatus and method which has many of the advantages of the liquid dispensers mentioned heretofore and many novel features that result in a new liquid dispensing apparatus which is not anticipated, rendered obvious, suggested, or even implied by any of the prior art liquid dispensers, either alone or in any combination thereof.

It is another object of the present invention to provide a new liquid dispensing apparatus which may be easily and efficiently manufactured and marketed.

It is a further object of the present invention to provide a new liquid dispensing apparatus which is of a durable and reliable construction.

An even further object of the present invention is to provide a new liquid dispensing apparatus which is susceptible of a low cost of manufacture with regard to both materials and labor, and which accordingly is then susceptible of low prices of sale to the consuming public, thereby making such liquid dispensing apparatus economically available to the buying public.

Still yet another object of the present invention is to provide a new liquid dispensing apparatus which provides in the apparatuses and methods of the prior art some of the advantages thereof, while simultaneously overcoming some of the disadvantages normally associated therewith.

Still another object of the present invention is to provide a new liquid dispensing apparatus for removably coupling to an arm of a user.

Yet another object of the present invention is to provide a new liquid dispensing apparatus which includes a container for holding a liquid. The container includes a first wall, a second wall and a peripheral wall extending between the first and second walls to define an interior for receiving the liquid. A port having a hole extending through it is provided for expelling the liquid. A conduit is provided for transporting the liquid from the container to the port. A first end of the conduit is fluidly connected to a second wall of the container. A second end of the conduit is fluidly connected to the port. A valve assembly is provided for controlling the flow of liquid through the conduit and is operationally coupled to a portion of the conduit. A plurality of fastening members is provided for fastening the apparatus to the arm of the user. One of the fastening members is mounted on the container and one of the fastening members is mounted on the port.

Still yet another object of the present invention is to provide a new liquid dispensing apparatus that allows a user to pay more attention to a task at hand, such as, for example, massaging a client, or bathing a child. By being able to carry a liquid, such as massage oil or liquid soap with them, a user will not have to leave their client or child unattended while retrieving the needed liquid.

Even still another object of the present invention is to provide a new liquid dispensing apparatus that allows a user to control the amount of liquid being dispensed. By controlling the amount of liquid being dispensed the user reduces the possibility of spills that can cause an individual to slip and injure themselves.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
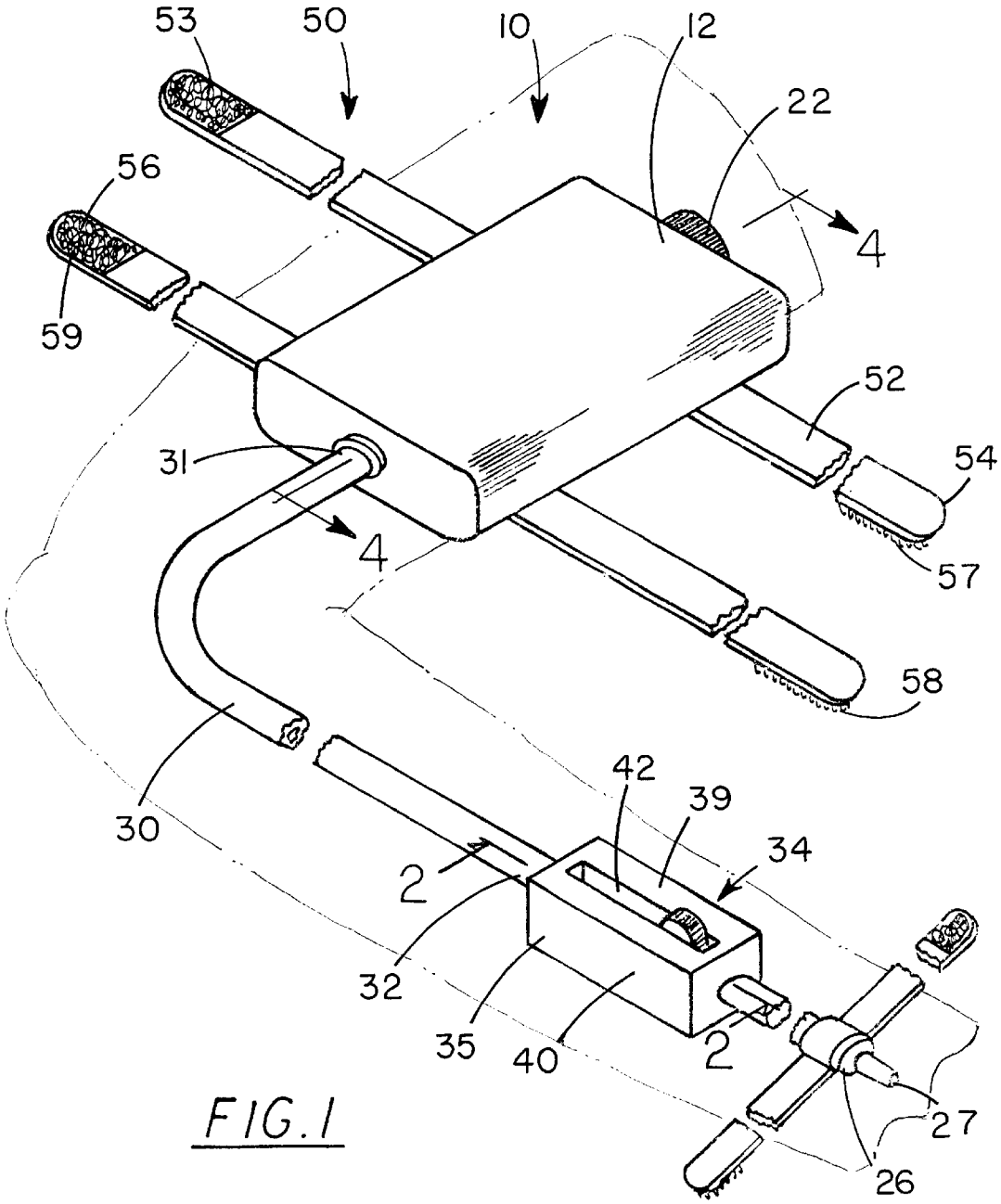
FIG. 1 is a schematic perspective view of a new liquid dispensing apparatus according to the present invention showing a container fluidly coupled to a port.

With reference now to the drawings, and in particular to FIGS. 1 through 4 thereof, a new liquid dispensing apparatus embodying the principles and concepts of the present invention and generally designated by the reference numeral 10 will be described.

As best illustrated in FIGS. 1 through 4, the liquid dispensing apparatus 10 generally comprises a container 12 for holding a liquid such as, for example, a massage oil. The container 12 includes a first wall 13, a second wall 14 and a peripheral wall 15 extending between the first wall 13 and second wall 14 to define an interior 16 for receiving the liquid. A neck portion 18 may be coupled to and extending away from the first wall 13. The neck portion 18 preferably includes a hole 19 extending through and into the interior 16 of the container 12 for filling the container 12 with liquid. An outer surface 20 of the neck portion 18 is preferably threaded.

The container 12 may comprise a substantially rigid material such as, for example, a plastic or a metal material. The container 12 may also comprise a generally flexible material such as, for example, a soft plastic that contours itself to the arm of the user. In either form, the container 12 preferably has the capacity to hold approximately eight fluid ounces of liquid. However, the container 12 may be manufactured in different sizes with varying capacities to hold liquid.

Figure 4:
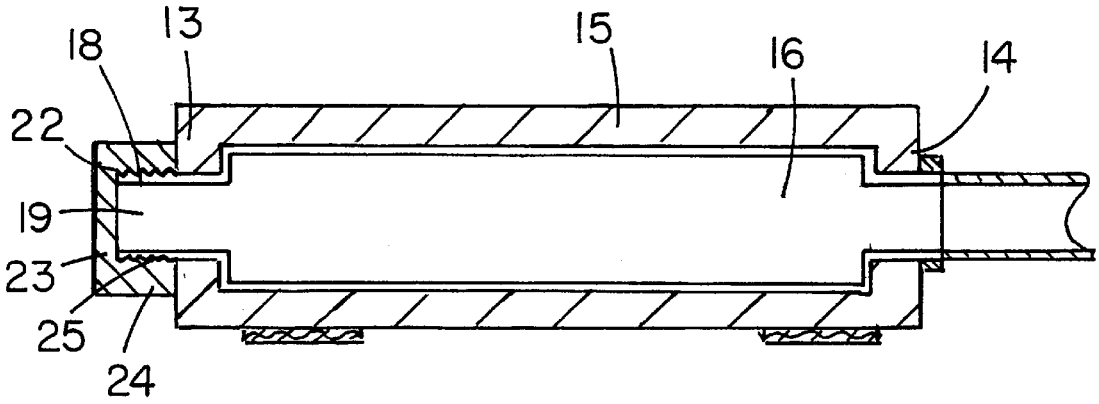
FIG. 4 is a schematic cross-sectional view of the present invention taken along line 4—4 of FIG. 1, showing an interior of the container.

As illustrated in FIG. 4, a cover 22 may be provided for selectively covering the hole 19 of the neck portion 18. The cover 22 preferably includes a base wall 23 and a perimeter wall 24 extending substantially perpendicularly away from the base wall 23. An inner surface 25 of the perimeter wall 24 is threaded and is releasably engagable with the threaded outer surface 20 of the neck portion 18.

Figure 3:
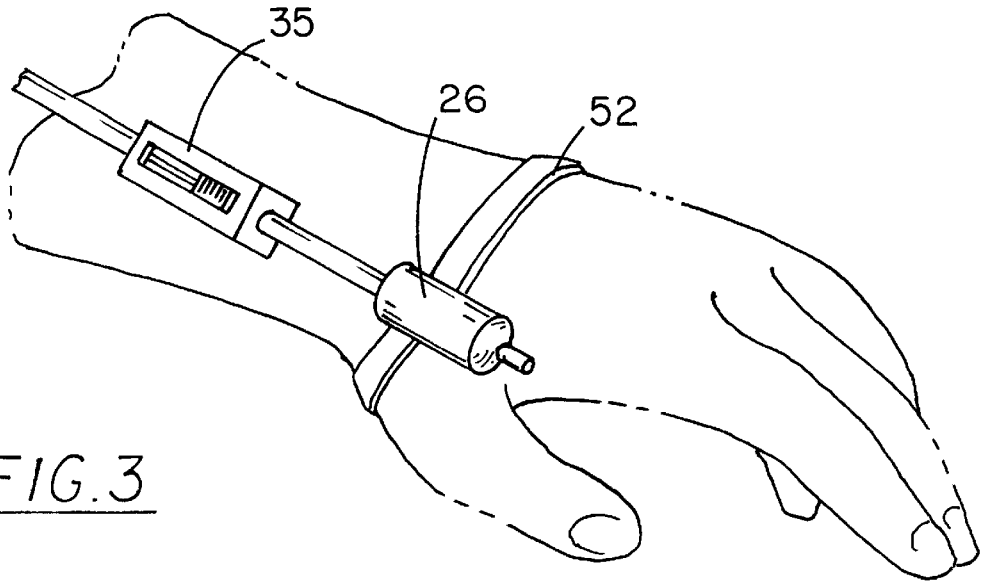
FIG. 3 is a schematic perspective view of the present invention showing the port coupled to a wrist portion of a user's arm.

As illustrated in FIGS. 1 and 3, a port 26 is provided for expelling the liquid onto the surface. The port 26 includes a hole 27 extending therethrough. The port 26 may comprise a substantially rigid material such as, for example, a plastic or a metal material.

As illustrated in FIG. 1, a conduit 30 is provided for transporting the liquid from the container 12 to the port 26. The conduit 30 includes a first end 31 and a second end 32. The first end 31 of the conduit 30 is fluidly coupled to the interior 16 of the container 12. The conduit 30 may comprise a substantially flexible material such as, for example, a plastic.

Figure 2:
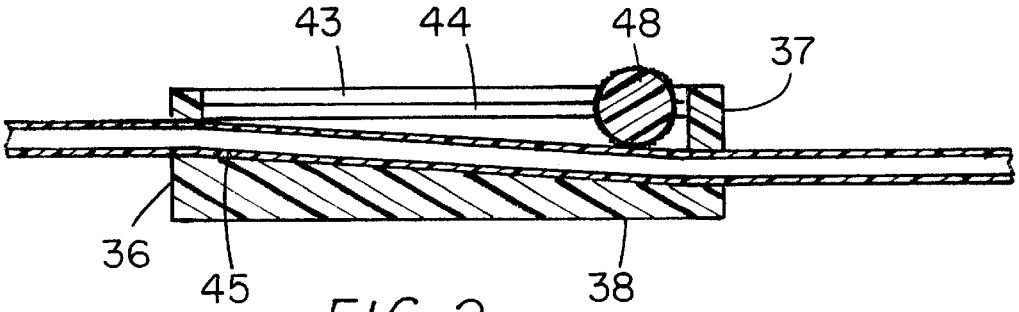
FIG. 2 is a schematic cross-sectional view of the present invention taken along line 2—2 of FIG. 1 showing a valve assembly for restricting the flow of liquid through a conduit.

As illustrated in FIGS. 1, 2, and 3, a valve assembly 34 is provided for controlling the flow of liquid through the conduit 30. The valve assembly 34 preferably comprises a housing 35 having a pressure wheel 48 movably mounted therein for applying pressure to the conduit 30 and restricting the flow of liquid through the conduit 30. The housing 35 includes a first end 36, a second end 37, a bottom wall 38, a top wall 39 and a pair of side walls 40. The top wall 39 includes a channel 42 extending therein. An inner surface 43 of each of the side walls 40 includes a track 44 extending between the first 36 and second 37 ends of the housing 35. A bottom surface 45 of the channel 42 gradually slopes from the first end 36 of the housing 35 toward the second end 37 of the housing 35. The conduit 30 preferably extends longitudinally through the housing 35 such that the conduit 30 is positioned generally adjacent to the bottom surface 45 of the channel 42.

The pressure wheel 48 is rotatably mounted in each of the tracks 44 such that when the pressure wheel 48 is rotatably moved toward the first end 36 of the housing 35 the pressure wheel 48 collapses the conduit 30 and restricts the flow of the liquid through the conduit 30.

As illustrated in FIG. 1, a plurality of fastening members 50 maybe provided for fastening the apparatus to the arm of the user. Each of the fastening members 50 preferably comprises a strip 52 that has a first end 53 and a second end 54. In one embodiment of the present invention, at least one strip 52 is mounted on the peripheral wall 15 of the container 12. A pair of strips 52 maybe mounted to the peripheral wall 15 of the container 12 for additionally securing the container 12 to the arm of the user. Each of the pair of strips 52 is positioned generally adjacent to a respective end 13 and 14 of the container 12.

In one embodiment of the present invention, one of the plurality of strips 52 maybe mounted on a portion of the port 26. The strip 52 mounted to the port 26 provides a means of securing the port 26 to a wrist portion of the user's arm.

As illustrated in FIG. 1, a pair of securing members 56 maybe provided for securing each of the ends 53 and 54 of a respective strip 52 together. Each of the securing members 56 preferably comprises a hook and loop fastener 57 that includes a hook portion 58 and a loop portion 59 that are releasably couplable to each other. Each of the portions 58 and 59 is attached to a respective end 53 and 54 of each of the strips 52 such that the ends 53 and 54 of each of the strips 52 are releasably couplable when a portion of each of the strips 52 is extended around the arm of the user.

In use, the user secures the container 12 to an upper portion of their arm while securing the port 26 to a wrist portion of their arm such that the port is positioned between a pair of phalanges of a user's hand. Gravity pulls the liquid in the container 12 through the conduit 30 to the valve assembly 35 where the user may control the flow of liquid to the port 26. Movement of the user's hand allows the user to control where the liquid exiting the port 26 will be placed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A liquid dispensing apparatus for coupling to an arm of a user, said apparatus comprising:

a container for holding a liquid, said container having a first wall, a second wall and a peripheral wall extending between said first and second walls to define an interior for receiving the liquid;

a port being in fluid communication with the interior of said container, said port having a nozzle with a hole for expelling liquid from said port along a dispensing axis;

a conduit for transporting the liquid from said container to said port, a first end of said conduit being fluidly connected to said interior of said container, a second end of said conduit being fluidly connected to said hole of said port;

a valve assembly for controlling the flow of liquid through said conduit, said valve assembly being operationally coupled to a portion of said conduit; and at least two fastening members for fastening about the arm of the user, each of said fastening members having a longitudinal length, a first one of said fastening members being mounted on said container for fastening said container on the arm of the user, and a second one of said fastening members being mounted on said port for fastening said container on a back of a wrist area of the arm of the user, said second fastening member being mounted on said port with the dispensing axis of said port being oriented substantially perpendicular to the longitudinal length of said second fastening member for generally aligning said dispensing axis with fingers of the user's arm such that liquid dispensed from said port past an end of the user's arm.

2. The liquid dispensing apparatus of claim 1, wherein said container additionally includes a neck portion being coupled to and extending away from said first wall, said neck portion having a hole extending through and into said interior of said container for filling the container with liquid.

3. The liquid dispensing apparatus of claim 2, wherein an outer surface of said neck portion is threaded.

4. The liquid dispensing apparatus of claim 3, additionally including:

a cover for selectively covering said hole of said neck portion, said cover having a base wall and a perimeter wall extending substantially perpendicularly away from said base wall, an inner surface of said perimeter wall being releasably engagable with said outer surface of said neck portion, said inner surface being threaded.

5. The liquid dispensing apparatus of claim 1, wherein said valve assembly comprises:

a housing having a first end, a second end, a top wall, a bottom wall and a pair of side walls, said top wall having a channel extending therein, wherein said conduit extends longitudinally through said housing; and a pressure wheel for applying pressure to said conduit and restricting the flow of the liquid through said conduit, said pressure wheel being rotatably mounted in said channel such that when said pressure wheel is rotatably moved toward said first end of said housing said pressure wheel collapses said conduit and restricts the flow of the liquid through said conduit.

6. The liquid dispensing apparatus of claim 5, wherein an inner surface of each of said side walls has a track extending between said first and second ends of said housing, said pressure wheel being rotatably mounted in each of said tracks, a bottom surface of said channel slopes from said first end of said housing toward said second end of said housing.

7. The liquid dispensing apparatus of claim 1, wherein said container has a pair of said plurality of said fastening members mounted thereon, each of said pair of fastening members being positioned generally adjacent to a respective end of said container.

8. The liquid dispensing apparatus of claim 7, wherein each of said fastening members comprises a strip having a first end and a second end.

9. The liquid dispensing apparatus of claim 8, additionally including:

a pair of securing members for securing each of said ends of said fastening members together, such that said ends of said strips are releasably coupled together.

10. The liquid dispensing apparatus of claim of claim 9, wherein each of said securing members comprising a hook and loop fastener having a hook portion and a loop portion, said hook portion being releasably couplable to said loop portion, each of said portions being attached to a respective end of each of said strips.

11. A liquid dispensing apparatus for coupling to an arm of a user, said apparatus comprising:

a container for holding a liquid, said container having a first wall, a second wall and a peripheral wall extending between said first and second walls to define an interior for receiving the liquid, a neck portion being coupled to and extending away from said first wall, said neck portion having a hole extending through and into said interior of said container for filling the container with liquid, an outer surface of said neck portion being threaded, said container comprising a substantially rigid material;

a cover for selectively covering said hole of said neck portion, said cover having a base wall and a perimeter wall extending substantially perpendicularly away from said base wall, an inner surface of said perimeter wall being releasably engagable with said outer surface of said neck portion, said inner surface being threaded;

a port being in fluid communication with the interior of said container, said port having a nozzle with a hole for expelling liquid from said port along a dispensing axis;

a conduit for transporting the liquid from said container to said port, said conduit having a first end and a second end, said first end of said conduit being fluidly coupled to said interior of said container, said conduit comprising a substantially flexible material;

a valve assembly for controlling the flow of liquid through said conduit, said valve assembly comprising:

a housing having a first end, a second end, a bottom wall, a top wall and a pair of side walls, said top wall having a channel extending therein, an inner surface of each of said side walls having a track extending between said first and second ends of said housing, a bottom surface of said channel sloping from said first end of said housing toward said second end of said housing, said conduit extending longitudinally through said housing, said conduit being positioned generally adjacent to said bottom surface of said channel;

a pressure wheel for applying pressure to said conduit and restricting the flow of the liquid through said conduit, said pressure wheel being rotatably mounted in each of said tracks such that when said pressure wheel is rotatably moved toward said first end of said housing the pressure wheel collapses said conduit and restricts the flow of the liquid through said conduit;

a plurality of a fastening members for fastening about the arm of the user, each of said fastening members comprising a strip having a first end and a second end, each of said fastening members having a longitudinal length between said first and second ends, a first one of said fastening members being mounted on said container for fastening said container on the arm of the user, and a second one of said fastening members being mounted on said port for fastening said container on a back of a wrist area of the arm of the user, said second fastening member being mounted on said port with the dispensing axis of said port being oriented substantially perpendicular to the longitudinal length of said second fastening member for generally aligning said dispensing axis with fingers of the user's arm such that liquid dispensed from said port past an end of the user's arm;

wherein a pair of said strips is mounted to said peripheral wall of said container, each of said pair of strips being positioned generally adjacent to a respective end of said container; and a pair of securing members for securing each of said ends of said fastening members together, each of said securing members comprising a hook and loop fastener having a hook portion and a loop portion, said hook portion being releasably couplable to said loop portion, each of said portions being attached to a respective end of each of said strips such that said ends of each of said fastening members are releasably couplable when a portion of each of said strips is extended around the arm of the user whereby securing said apparatus to the user's arm;

wherein the housing of said valve assembly is separate from said port, said port being connected to said valve assembly by a length of conduit extending therebetween such that the housing of said valve assembly is positionable adjacent to a forearm of the user's arm and said port is positionable adjacent to the wrist area of the user's arm.

12. The liquid dispensing apparatus of claim 1, wherein said valve assembly includes a housing separate from said port, said port being connected to said valve assembly by a length of conduit extending therebetween such that the housing of said valve assembly is positionable adjacent to a forearm of the user's arm and said port is positionable adjacent to the wrist area of the user's arm.

* * * * *